US011375753B2

(12) United States Patent
Fursa et al.

(10) Patent No.: US 11,375,753 B2
(45) Date of Patent: Jul. 5, 2022

(54) AEROSOL-GENERATING DEVICE HAVING AN INDUCTOR COIL WITH REDUCED SEPARATION

(71) Applicant: Philip Morris Products S.A., Neuchatel (CH)

(72) Inventors: Oleg Fursa, Gempenach (CH); Oleg Mironov, Cudrefin (CH); Tony Reevell, London (GB); Ihar Nikolaevich Zinovik, Peseux (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/623,536

(22) PCT Filed: Aug. 9, 2018

(86) PCT No.: PCT/EP2018/071705

§ 371 (c)(1),
(2) Date: Dec. 17, 2019

(87) PCT Pub. No.: WO2019/030361

PCT Pub. Date: Feb. 14, 2019

(65) Prior Publication Data

US 2021/0145061 A1 May 20, 2021

(30) Foreign Application Priority Data

Aug. 9, 2017 (EP) ..... 17185601

(51) Int. Cl.
*A24F 13/00* (2006.01)
*A24F 40/465* (2020.01)
*A24F 40/20* (2020.01)

(52) U.S. Cl.
CPC ..... *A24F 40/465* (2020.01); *A24F 40/20* (2020.01)

(58) Field of Classification Search
CPC ..... A24F 47/00
(Continued)

(56) References Cited

U.S. PATENT DOCUMENTS

2016/0150825 A1 6/2016 Mironov et al.
2016/0309784 A1 10/2016 Silvestrini et al.
(Continued)

FOREIGN PATENT DOCUMENTS

CN 206137197 U 5/2017
CN 206227716 U 6/2017
(Continued)

OTHER PUBLICATIONS

International Search Report dated Nov. 16, 2018 in PCT/EP2018/071705 filed on Aug. 9, 2018, 5 pages.
(Continued)

*Primary Examiner* — Phuong K Dinh
(74) *Attorney, Agent, or Firm* — Oblon, McClelland, Maier & Neustadt, L.L.P.

(57) ABSTRACT

An aerosol-generating device is provided, including a housing defining a chamber configured to receive at least a portion of an aerosol-generating article; an inductor coil disposed at least partially within the chamber, the housing defining a recess in an inner surface of the chamber, and the inductor coil being at least partially disposed within the recess; and a power supply and a controller connected to the inductor coil and configured to provide an alternating electric current to the inductor coil such that the inductor coil generates an alternating magnetic field to inductively heat a susceptor element and thereby heat at least a portion of the aerosol-generating article received within the inductor coil.

14 Claims, 5 Drawing Sheets

(58) Field of Classification Search
USPC ..... 131/328–329
See application file for complete search history.

(56) References Cited

U.S. PATENT DOCUMENTS

| | | | |
|---|---|---|---|
| 2017/0027233 A1 | 2/2017 | Mironov et al. | |
| 2017/0055580 A1 | 3/2017 | Blandino et al. | |
| 2017/0055585 A1 | 3/2017 | Fursa et al. | |
| 2017/0055587 A1 | 3/2017 | Zinovik et al. | |
| 2017/0079326 A1 | 3/2017 | Mironov et al. | |
| 2017/0172208 A1 | 6/2017 | Mironov | |
| 2020/0375255 A1* | 12/2020 | Courbat | A24F 40/465 |

FOREIGN PATENT DOCUMENTS

| | | | |
|---|---|---|---|
| RU | 2 517 125 | C2 | 5/2014 |
| RU | 2 605 837 | C2 | 12/2016 |
| RU | 2 617 297 | C2 | 4/2017 |
| RU | 2015 148 609 | A | 5/2017 |
| WO | WO 95/27411 | A1 | 10/1995 |
| WO | WO 2014/048745 | A1 | 4/2014 |
| WO | WO 2015/091258 | A1 | 6/2015 |
| WO | WO 2015/131058 | A1 | 9/2015 |
| WO | WO 2015/175568 | A1 | 11/2015 |
| WO | WO 2015/176898 | A1 | 11/2015 |
| WO | WO 2015/177043 | A1 | 11/2015 |
| WO | WO 2015/177044 | A1 | 11/2015 |
| WO | WO 2015/177045 | A1 | 11/2015 |
| WO | WO 2015/177046 | A1 | 11/2015 |
| WO | WO 2015/177247 | A1 | 11/2015 |
| WO | WO 2015/177252 | A1 | 11/2015 |
| WO | WO 2015/177253 | A1 | 11/2015 |
| WO | WO 2015/177254 | A1 | 11/2015 |
| WO | WO 2015/177256 | A1 | 11/2015 |
| WO | WO 2015/177257 | A1 | 11/2015 |
| WO | WO 2015/177263 | A1 | 11/2015 |
| WO | WO 2015/177264 | A1 | 11/2015 |
| WO | WO 2015/177265 | A1 | 11/2015 |
| WO | WO 2015/177294 | A1 | 11/2015 |
| WO | WO 2015/198015 | A1 | 12/2015 |
| WO | WO 2016/075436 | A1 | 5/2016 |
| WO | WO 2016/090037 | A1 | 6/2016 |
| WO | WO 2016/156500 | A1 | 10/2016 |
| WO | WO 2016/184928 | A1 | 11/2016 |
| WO | WO 2016/184929 | A1 | 11/2016 |
| WO | WO 2016/184930 | A1 | 11/2016 |
| WO | WO 2017/001818 | A1 | 1/2017 |
| WO | WO 2017/001819 | A1 | 1/2017 |
| WO | WO 2017/001820 | A1 | 1/2017 |
| WO | WO 2017/005705 | A1 | 1/2017 |
| WO | WO 2017/029268 | A1 | 2/2017 |
| WO | WO 2017/029269 | A1 | 2/2017 |
| WO | WO 2017/029270 | A1 | 2/2017 |
| WO | WO 2017/036950 | A2 | 3/2017 |
| WO | WO 2017/036951 | A1 | 3/2017 |
| WO | WO 2017/036954 | A1 | 3/2017 |
| WO | WO 2017/036955 | A2 | 3/2017 |
| WO | WO 2017/036957 | A1 | 3/2017 |
| WO | WO 2017/036958 | A2 | 3/2017 |
| WO | WO 2017/036959 | A1 | 3/2017 |
| WO | WO 2017/064487 | A1 | 4/2017 |
| WO | WO 2017/068092 | A1 | 4/2017 |
| WO | WO 2017/068095 | A1 | 4/2017 |
| WO | WO 2017/068098 | A1 | 4/2017 |
| WO | WO 2017/068099 | A1 | 4/2017 |
| WO | WO 2017/068100 | A1 | 4/2017 |
| WO | WO 2017/072144 | A1 | 5/2017 |
| WO | WO 2017/072145 | A1 | 5/2017 |
| WO | WO 2017/072148 | A1 | 5/2017 |
| WO | WO 2017/072149 | A1 | 5/2017 |
| WO | WO 2017/077503 | A1 | 5/2017 |
| WO | WO 2017/085242 | A1 | 5/2017 |

OTHER PUBLICATIONS

Written Opinion dated Nov. 16, 2018 in PCT/EP2018/071705 filed on Aug. 9, 2018.

Extended European Search Report dated Nov. 28, 2017 in European Patent Application No. 17185601.6, 9 pages.

Combine Russian Federation Office Action and Search Report dated Nov. 16, 2021 in Russian Federation Patent Application No. 2020109336/03(015232) (with English translation), 11 pages.

* cited by examiner

AEROSOL-GENERATING DEVICE HAVING AN INDUCTOR COIL WITH REDUCED SEPARATION

CROSS-REFERENCE TO RELATED APPLICATIONS

This application is a U.S. national stage application of PCT/EP2018/071705, filed on Aug. 9, 2018, which is based upon and claims the benefit of priority from European patent application no. 17185601.6, filed Aug. 9, 2017, the entire contents of each of which are incorporated herein by reference.

TECHNICAL FIELD

The present invention relates to an aerosol-generating device having an inductor coil arranged to contact an aerosol-generating article. The present invention also relates to an aerosol-generating system comprising the aerosol-generating device and an aerosol-generating article for use with the aerosol-generating device.

DESCRIPTION OF THE RELATED ART

A number of electrically-operated aerosol-generating systems in which an aerosol-generating device having an electric heater is used to heat an aerosol-forming substrate, such as a tobacco plug, have been proposed in the art. One aim of such aerosol-generating systems is to reduce known harmful smoke constituents of the type produced by the combustion and pyrolytic degradation of tobacco in conventional cigarettes. Typically, the aerosol-generating substrate is provided as part of an aerosol-generating article which is inserted into a chamber or cavity in the aerosol-generating device. In some known systems, to heat the aerosol-forming substrate to a temperature at which it is capable of releasing volatile components that can form an aerosol, a resistive heating element such as a heating blade is inserted into or around the aerosol-forming substrate when the article is received in the aerosol-generating device. In other aerosol-generating systems, an inductive heater is used rather than a resistive heating element. The inductive heater typically comprises an inductor forming part of the aerosol-generating device and an electrically conductive susceptor element within the aerosol-generating device and arranged such that it is in thermal proximity to the aerosol-forming substrate. During use, the inductor generates an alternating magnetic field to generate eddy currents and hysteresis losses in the susceptor element, causing the susceptor element to heat up, thereby heating the aerosol-forming substrate.

Inductive heating systems rely on inductive energy transfer from the inductor to the susceptor element. It would be desirable to provide an aerosol-generating device that improves the energy transfer from an inductor to a susceptor element.

SUMMARY

According to a first aspect of the present invention there is provided an aerosol-generating device comprising a housing defining a chamber for receiving at least a portion of an aerosol-generating article and an inductor coil disposed at least partially within the chamber. The aerosol-generating device also comprises a power supply and a controller connected to the inductor coil and configured to provide an alternating electric current to the inductor coil such that, in use, the inductor coil generates an alternating magnetic field to inductively heat a susceptor element and thereby heat at least a portion of an aerosol-generating article received within the chamber.

According to a second aspect of the present invention there is provided an aerosol-generating system. The aerosol-generating system comprises an aerosol-generating device according to the first aspect of the present invention, in accordance with any of the embodiments described herein. The aerosol-generating system also comprises an aerosol-generating article having an aerosol-forming substrate and configured for use with the aerosol-generating device.

According to a third aspect of the present invention there is provided an aerosol-generating system comprising an aerosol-generating device, a susceptor element, and an aerosol-generating article comprising an aerosol-forming substrate. The aerosol-generating device comprises a housing and an inductor coil disposed within the housing for receiving at least a portion of the aerosol-generating article within the inductor coil so that, when an aerosol-generating article is received within the inductor coil, the inductor coil contacts the aerosol-generating article. The susceptor element is configured for disposal of at least a portion of the susceptor element within the inductor coil. The aerosol-generating device also comprises a power supply and a controller connected to the inductor coil and configured to provide an alternating electric current to the inductor coil such that, in use, the inductor coil generates an alternating magnetic field to inductively heat the susceptor element and thereby heat at least a portion of the aerosol-generating article received within the inductor coil.

The aerosol-generating device may comprise any of the optional or preferred features described herein with reference to the first aspect of the present invention.

The aerosol-generating article may comprise any of the optional or preferred features described herein with reference to the second aspect of the present invention.

According to a fourth aspect of the present invention, there is provided an aerosol-generating device comprising a housing and an inductor coil disposed within the housing for receiving at least a portion of an aerosol-generating article within the inductor coil so that, when an aerosol-generating article is received within the inductor coil, the inductor coil contacts the aerosol-generating article. The aerosol-generating device also comprises a power supply and a controller connected to the inductor coil and configured to provide an alternating electric current to the inductor coil such that, in use, the inductor coil generates an alternating magnetic field to inductively heat a susceptor element and thereby heat at least a portion of an aerosol-generating article received within the inductor coil.

The aerosol-generating device may comprise any of the optional or preferred features described herein with reference to the first aspect of the present invention.

According to a fifth aspect of the present invention there is provided an aerosol-generating system. The aerosol-generating system comprises an aerosol-generating device according to the fourth aspect of the present invention, in accordance with any of the embodiments described herein. The aerosol-generating system also comprises an aerosol-generating article having an aerosol-forming substrate and configured for use with the aerosol-generating device. The aerosol-generating article may comprise any of the optional or preferred features described herein with reference to the second aspect of the present invention.

BRIEF DESCRIPTION OF THE DRAWINGS

The invention will be further described, by way of example only, with reference to the accompanying drawings in which.

DETAILED DESCRIPTION

Figure 1:
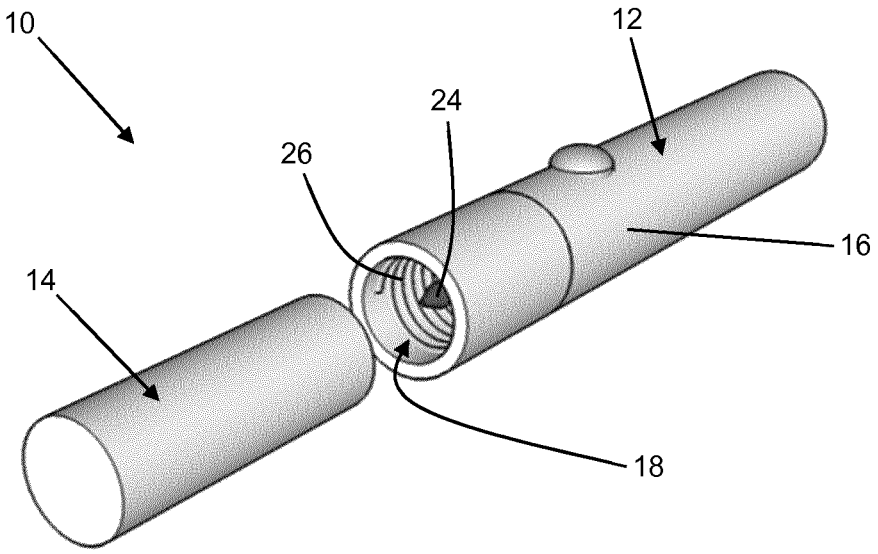
FIG. 1 shows a perspective view of an aerosol-generating system according to a first embodiment of the present invention.
Figure 2:
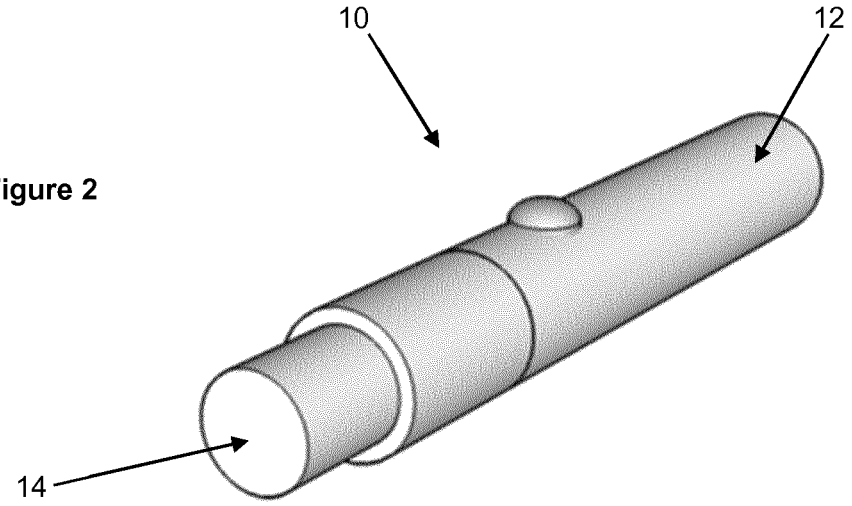
FIG. 2 shows a perspective view of the aerosol-generating system of FIG. 1 with the aerosol-generating article inserted into the aerosol-generating device.
Figure 3:
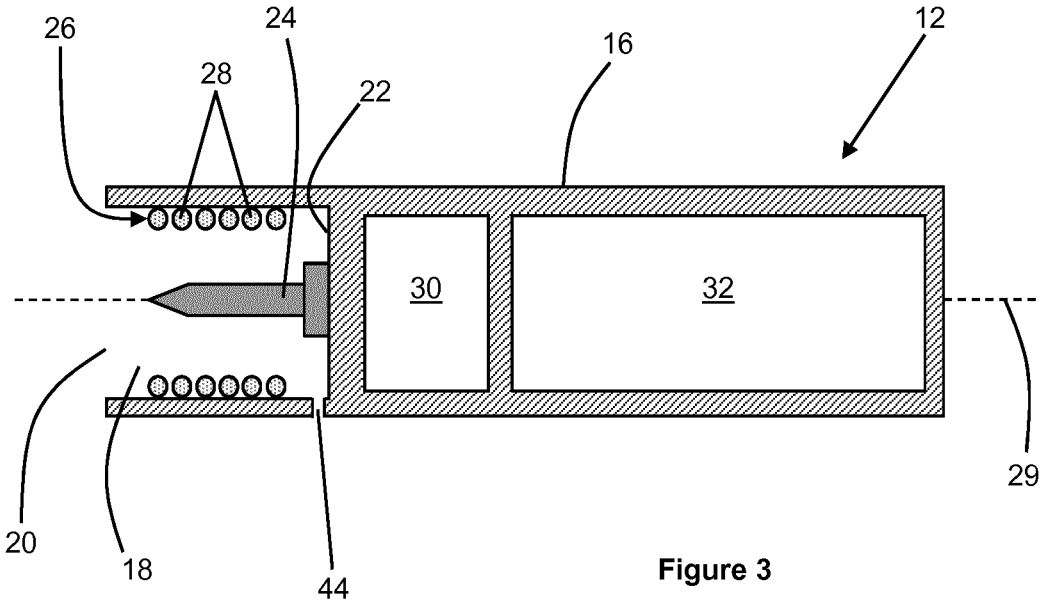
FIG. 3 shows a cross-sectional view of the aerosol-generating device of the aerosol-generating system of FIG. 1.
Figure 4:
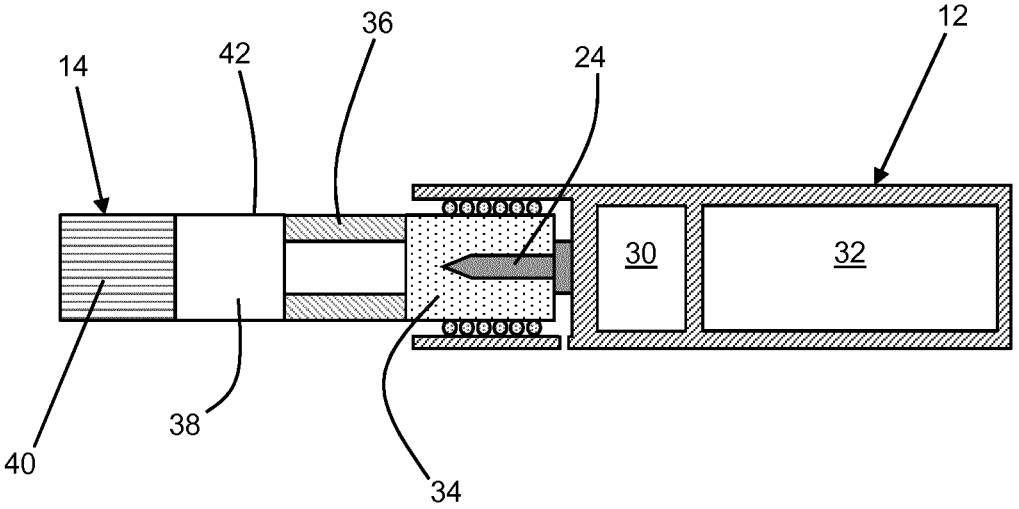
FIG. 4 shows a cross-sectional view of the aerosol-generating system of FIG. 2.

As used herein, the term "longitudinal" is used to describe the direction along the main axis of the aerosol-generating device, or of an aerosol-generating article, and the term 'transverse' is used to describe the direction perpendicular to the longitudinal direction. When referring to the chamber or the inductor coil, 'longitudinal' refers to the direction in which an aerosol-generating article is inserted into the chamber or the inductor coil and the term 'transverse' refers to a direction perpendicular to the direction in which an aerosol-generating article is inserted into the chamber or the inductor coil.

As used herein, the term "width" refers to the major dimension in a transverse direction of a component of the aerosol-generating device, or of an aerosol-generating article, at a particular location along its length. The term "thickness" refers to the dimension of a component of the aerosol-generating device, or of an aerosol-generating article, in a transverse direction perpendicular to the width.

As used herein, the term "aerosol-forming substrate" relates to a substrate capable of releasing volatile compounds that can form an aerosol. Such volatile compounds may be released by heating the aerosol-forming substrate. An aerosol-forming substrate is part of an aerosol-generating article.

As used herein, the term "aerosol-generating article" refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick.

As used herein, the term "aerosol-generating device" refers to a device that interacts with an aerosol-generating article to generate an aerosol.

As used herein, the term "aerosol-generating system" refers to the combination of an aerosol-generating article, as further described and illustrated herein, with an aerosol-generating device, as further described and illustrated herein. In an aerosol-generating system, the aerosol-generating article and the aerosol-generating device cooperate to generate a respirable aerosol.

As used herein, the term "elongate" refers to a component having a length which is greater than both its width and thickness, for example twice as great.

As used herein, a "susceptor element" means an electrically conductive element that heats up when subjected to a changing magnetic field. This may be the result of eddy currents induced in the susceptor element, hysteresis losses, or both eddy currents and hysteresis losses. In use, the susceptor element is located in thermal contact or close thermal proximity with the aerosol-forming substrate of an aerosol-generating article received in the inductor coil of the aerosol-generating device. In this manner, the aerosol-forming substrate is heated by the susceptor element during use such that an aerosol is formed. The susceptor element may form part of the aerosol-generating device or part of an aerosol-generating article.

Advantageously, the use of inductive heating rather than resistive heating may provide improved energy conversion because of power losses associated with a resistive heater, in particular losses due to contact resistance at connections between the resistive heater and the power supply.

Advantageously, disposing the inductor coil at least partially within the chamber may reduce or minimise the distance between the inductor coil and a susceptor element. Advantageously, disposing the inductor coil at least partially within the chamber may eliminate any intervening materials between the inductor coil and the aerosol-generating article. Advantageously, one or both of these features may maximise the inductive energy transfer from the inductor coil to the susceptor element. This may be particularly significant in embodiments in which the susceptor element is positioned inside the aerosol-generating article during use.

The aerosol-generating article may comprise a susceptor element disposed at least partially within the inductor coil. Advantageously, providing both the inductor coil and a susceptor element as parts of the aerosol-generating device makes it possible to construct an aerosol-generating article that is simple, inexpensive and robust. Aerosol-generating articles are typically disposable and produced in much larger numbers that the aerosol-generating devices with which they operate. Accordingly, reducing the cost of the articles, even if it requires a more expensive device, can lead to significant cost savings for both manufacturers and consumers.

Preferably, the susceptor element is an elongate susceptor element. Preferably, the elongate susceptor element is arranged for insertion into an aerosol-generating article when the aerosol-generating article is inserted into the inductor coil. Advantageously, an elongate susceptor element arranged for insertion into an aerosol-generating article may optimise the transfer of heat from the susceptor element to an aerosol-forming substrate of the aerosol-generating article.

Preferably the susceptor element extends into the inductor coil and the chamber from the closed end of the chamber.

The inductor coil may be configured to receive at least a portion of an aerosol-generating article within the inductor coil when the at least a portion of the aerosol-generating article is received within the chamber. Preferably, the inductor coil is configured so that, when an aerosol-generating article is received within the inductor coil, the inductor coil contacts the aerosol-generating article.

Advantageously, configuring the inductor coil to contact an aerosol-generating article received within the inductor coil may increase heating of the aerosol-generating article during use. For example, an inductor coil typically exhibits a relatively small amount of resistive heating when an alternating electric current is provided to the inductor coil. Therefore, providing contact between the inductor coil and the aerosol-generating article may facilitate conductive transfer of heat from the inductor coil to the aerosol-generating article.

Advantageously, configuring the inductor coil to contact an aerosol-generating article received within the inductor coil may facilitate retention of the aerosol-generating article within the aerosol-generating device during use. For example, the contact between the inductor coil and the aerosol-generating article may provide a desired degree of friction to reduce the risk of the aerosol-generating article sliding out of the chamber during use.

The housing may comprise at least one slot extending through the housing and in communication with the chamber. The inductor coil is exposed to the chamber through the slot so that the inductor coil contacts an aerosol-forming article received within the chamber. The inductor coil may partially extend through the slot and into the chamber.

The housing may comprise an outer housing portion and an inner housing portion, wherein the inner housing portion defines the at least one slot. An outer surface of the inductor coil may abut an inner surface of the outer housing portion. The inductor coil may be formed from a resilient material to bias the outer surface of the inductor coil against the inner surface of the outer housing portion.

Advantageously, embodiments in which the inductor coil partially extends through at least one slot in an inner housing portion may facilitate retention of the inductor coil within the housing. For example, the inductor coil may be inserted into the chamber and expanded into the at least one slot and against the outer housing portion.

The inductor coil may be disposed within the chamber. That is, the inductor coil may be disposed substantially entirely within the chamber. An inner surface of the housing may at least partially define the chamber, wherein an outer surface of the inductor coil abuts the inner surface of the housing. The inductor coil may be formed from a resilient material to bias the outer surface of the inductor coil against the inner surface of the housing.

The housing may define a recess in an inner surface of the chamber. Preferably an inner surface of the housing forms the recess. The inductor coil may be at least partially disposed within the recess. Advantageously, the recess may facilitate retention of the inductor coil within the chamber.

The recess may be pre-formed in the housing so that the inductor coil is inserted into the recess during assembly of the aerosol-generating device. For example, the inductor coil may be inserted into the chamber and expanded into the recess. This may facilitate construction of the housing and the inductor coil in separate manufacturing processes.

An outer surface of the inductor coil may be overmoulded with a portion of the housing, wherein the overmoulded portion of the housing forms the recess. Advantageously, this integrates manufacture of the housing and assembly of the inductor coil with the housing into a single manufacturing step. For example, at least a portion of the housing may be formed by overmoulding the housing over a pre-formed inductor coil. Advantageously, the overmoulding may facilitate retention of the inductor coil within the recess. For example, the overmoulding step may bond an outer surface of the inductor coil to the housing.

The housing may define a chamber having a substantially constant cross-sectional shape along a length of the chamber. For example, the chamber may define a volume having a substantially cylindrical shape, such as a circular cylindrical shape or an elliptical cylindrical shape. An outer surface of the inductor coil may abut an inner surface of the chamber. The inductor coil may be formed from a resilient material to bias the outer surface of the inductor coil against the inner surface of the chamber. The outer surface of the inductor coil may be bonded to the inner surface of the chamber, for example using an adhesive.

In any of the embodiments described herein, each winding of the inductor coil may be spaced apart from the adjacent windings of the inductor coil. Advantageously, the spacing between adjacent windings may form a helical channel between the windings of the inductor coil. Advantageously, the helical channel may facilitate airflow through the chamber when an aerosol-generating article is received within the chamber. For example, in embodiments in which the inductor coil is configured to contact an aerosol-generating article received within the inductor coil, airflow may pass along the helical channel when an aerosol-generating article is received within the inductor coil. Advantageously, the spacing between adjacent windings may be adjusted to provide the helical channel with a desired cross-sectional area. Advantageously, this may provide a desired resistance to draw, for example.

The inductor coil may be configured so that each winding of the inductor coil contacts the adjacent windings of the inductor coil. Advantageously, this eliminates gaps between adjacent windings of the inductor coil. Advantageously, this may reduce or eliminate the risk of contaminants or debris becoming lodged between windings of the inductor coil. This is particularly advantageous since the inductor coil is arranged to contact an aerosol-generating article received within the inductor coil. Advantageously, eliminating gaps between adjacent windings of the inductor coil increases the number of windings per unit length of the inductor coil, which increases the inductance of the inductor coil.

Preferably, the inductor coil is formed from a wire comprising an electrically conductive core and an outer layer surrounding the electrically conductive core, the outer layer comprising an electrically insulating material. Advantageously, the outer layer prevents an electrical short circuit between adjacent windings of the inductor coil. Advantageously, the outer layer electrically isolates the inductor coil from an aerosol-generating article received within the inductor coil. The outer layer may comprise at least one of a glass and a ceramic.

The inductor coil may be formed from a wire having a substantially rectangular cross-sectional shape. As used herein, a rectangular shape may be any right-angled parallelogram, including square. Preferably, the inductor coil is formed from a wire having a substantially square cross-sectional shape.

Advantageously, forming the inductor coil from a wire having a substantially rectangular cross-sectional shape may facilitate elimination of gaps between adjacent windings of the inductor coil in embodiments in which each winding contacts the adjacent windings. Preferably, planar surfaces of each winding of the inductor coil contact planar surfaces of adjacent windings of the inductor coil.

Preferably, the inductor coil defines a lumen extending through the inductor coil for receiving an aerosol-generating article. In embodiments in which the inductor coil is formed from a wire having a substantially rectangular cross-sectional shape and each winding contacts the adjacent windings, preferably a plurality of consecutive windings of the inductor coil define a first portion of the lumen having a constant cross-sectional area. Advantageously, the first portion of the lumen having a constant cross-sectional area may form a smooth portion of an inner surface of the inductor coil. Advantageously, a smooth portion of an inner surface of the inductor coil may facilitate insertion of an aerosol-generating article into the inductor coil. Advantageously, a smooth portion of an inner surface of the inductor coil may increase the contact area between the inductor coil and an aerosol-generating article received within the inductor coil. Advantageously, this may facilitate retention of an aerosol-generating article within the inductor coil.

Preferably, the lumen has a first end, a second end and a length extending between the first end and the second end.

The lumen may have a substantially constant cross-sectional area along its length.

The inductor coil may be arranged within the housing so that an aerosol-generating article inserted into the inductor coil enters the lumen through the first end of the lumen. In embodiments in which the inductor coil defines a first portion of the lumen having a constant cross-sectional area, the inductor coil may define a second portion of the lumen extending between the first portion of the lumen and the first end of the lumen, wherein a cross-sectional area of the second portion increases in a direction from the first portion towards the first end. Advantageously, this may provide the lumen with a tapering cross-sectional area which may facilitate insertion of an aerosol-generating article into the inductor coil. Preferably, a cross-sectional area of the lumen at the first end is larger than a cross-sectional area of the lumen within the first portion. Preferably, the cross-sectional area of the lumen within the first portion is substantially the same as a cross-sectional area of a portion of an aerosol-generating article configured for insertion into the inductor coil.

The first portion of the lumen may extend between the second portion and the second end of the lumen.

In embodiments in which an outer surface of the inductor coil abuts an inner surface of a recess or a chamber defined by the housing, preferably variations in the cross-sectional profile of the recess or the chamber correspond to variations in the cross-sectional profile of the lumen.

In embodiments in which the aerosol-generating device comprises a susceptor element, the susceptor element may be formed from any material that can be inductively heated to a temperature sufficient to aerosolise an aerosol-forming substrate. Suitable materials for the susceptor element include graphite, molybdenum, silicon carbide, stainless steels, niobium, and aluminium. Preferred susceptor elements comprise a metal or carbon. Preferably, the susceptor element comprises or consists of a ferromagnetic material, for example, ferritic iron, a ferromagnetic alloy, such as ferromagnetic steel or stainless steel, ferromagnetic particles, and ferrite. A suitable susceptor element may be, or comprise, aluminium. The susceptor element preferably comprises more than about 5 percent, preferably more than about 20 percent, more preferably more than about 50 percent or more than 90 percent of ferromagnetic or paramagnetic materials. Preferred susceptor elements may be heated to a temperature in excess of about 250 degrees Celsius.

The susceptor element may comprise a non-metallic core with a metal layer disposed on the non-metallic core. For example, the susceptor element may comprise one or more metallic tracks formed on an outer surface of a ceramic core or substrate.

The susceptor element may have a protective external layer, for example a protective ceramic layer or protective glass layer. The protective external layer may encapsulate the susceptor element. The susceptor element may comprise a protective coating formed by a glass, a ceramic, or an inert metal, formed over a core of susceptor material.

The susceptor element may have any suitable cross-section. For example, the susceptor element may have a square, oval, rectangular, triangular, pentagonal, hexagonal, or similar cross-sectional shape. The susceptor element may have a planar or flat cross-sectional shape.

The susceptor element may be solid, hollow, or porous. Preferably, the susceptor element is solid.

In embodiments in which the susceptor element has a planar or flat cross-sectional shape, preferably the susceptor element has a thickness of between about 1 millimetre and about 8 millimetres, more preferably from about 3 millimetres to about 5 millimetres. The thickness of the susceptor element is measured in a longitudinal direction of the aerosol-generating device. Preferably, the susceptor element has a width or a diameter of between about 3 millimetres and about 12 millimetres, more preferably between about 4 millimetres and about 10 millimetres, more preferably between about 5 millimetres and about 8 millimetres. The width or diameter of the susceptor element is orthogonal to its thickness.

In embodiments in which the susceptor element is an elongate susceptor element, preferably the elongate susceptor element is in the form of a pin, rod, blade, or plate. Preferably, the elongate susceptor element has a length of between about 5 millimetres and about 15 millimetres, for example between about 6 millimetres and about 12 millimetres, or between about 8 millimetres and about 10 millimetres. The elongate susceptor element preferably has a width of between about 1 millimetre and about 8 millimetres, more preferably from about 3 millimetres to about 5 millimetres. The elongate susceptor element may have a thickness of from about 0.01 millimetres to about 2 millimetres. If the elongate susceptor element has a constant cross-section, for example a circular cross-section, it has a preferable width or diameter of between about 1 millimetre and about 5 millimetres.

Preferably, the aerosol-generating device is portable. The aerosol-generating device may have a size comparable to a conventional cigar or cigarette. The aerosol-generating device may have a total length between approximately 30 millimetres and approximately 150 millimetres. The aerosol-generating device may have an external diameter between approximately 5 millimetres and approximately 30 millimetres.

The aerosol-generating device housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The housing may comprise a mouthpiece. The mouthpiece may comprise at least one air inlet and at least one air outlet. The mouthpiece may comprise more than one air inlet. One or more of the air inlets may reduce the temperature of the aerosol before it is delivered to a user and may reduce the concentration of the aerosol before it is delivered to a user.

Alternatively, the mouthpiece may be provided as part of an aerosol-generating article.

As used herein, the term "mouthpiece" refers to a portion of an aerosol-generating device that is placed into a user's mouth in order to directly inhale an aerosol generated by the aerosol-generating device from an aerosol-generating article received in the chamber of the housing.

The aerosol-generating device may include a user interface to activate the device, for example a button to initiate heating of the device or display to indicate a state of the device or of the aerosol-forming substrate.

The aerosol-generating device comprises a power supply. The power supply may be a battery, such as a rechargeable lithium ion battery. Alternatively, the power supply may be another form of charge storage device such as a capacitor. The power supply may require recharging. The power supply may have a capacity that allows for the storage of enough energy for one or more uses of the device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations.

The power supply may be a DC power supply. In one embodiment, the power supply is a DC power supply having a DC supply voltage in the range of about 2.5 Volts to about 4.5 Volts and a DC supply current in the range of about 1 Amp to about 10 Amps (corresponding to a DC power supply in the range of about 2.5 Watts to about 45 Watts).

The power supply may be configured to operate at high frequency. As used herein, the term "high frequency oscillating current" means an oscillating current having a frequency of between about 500 kilohertz and about 30 megahertz. The high frequency oscillating current may have a frequency of from about 1 megahertz to about 30 megahertz, preferably from about 1 megahertz to about 10 megahertz and more preferably from about 5 megahertz to about 8 megahertz.

The aerosol-generating device comprises a controller connected to the inductor coil and the power supply. The controller is configured to control the supply of power to the inductor coil from the power supply. The controller may comprise a microprocessor, which may be a programmable microprocessor, a microcontroller, or an application specific integrated chip (ASIC) or other electronic circuitry capable of providing control. The controller may comprise further electronic components. The controller may be configured to regulate a supply of current to the inductor coil. Current may be supplied to the inductor coil continuously following activation of the aerosol-generating device or may be supplied intermittently, such as on a puff by puff basis. The controller may advantageously comprise DC/AC inverter, which may comprise a Class-D or Class-E power amplifier.

The aerosol-generating article may comprise a susceptor element. In embodiments in which the aerosol-generating device comprises a susceptor element, the susceptor element in the aerosol-generating article may be in addition to the susceptor element in the aerosol-generating device. Preferably, the aerosol-generating article comprises a susceptor element in embodiments in which the aerosol-generating device does not include a susceptor element.

The susceptor element may be positioned adjacent the aerosol-forming substrate. Preferably, the susceptor is positioned within the aerosol-forming substrate.

The susceptor element may comprise any of the optional or preferred features described herein with reference to the first aspect of the present invention.

The aerosol-forming substrate may comprise nicotine. The nicotine-containing aerosol-forming substrate may be a nicotine salt matrix. The aerosol-forming substrate may comprise plant-based material. The aerosol-forming substrate may comprise tobacco. The aerosol-forming substrate may comprise a tobacco-containing material including volatile tobacco flavour compounds which are released from the aerosol-forming substrate upon heating. Alternatively, the aerosol-forming substrate may comprise a non-tobacco material. The aerosol-forming substrate may comprise homogenised plant-based material. The aerosol-forming substrate may comprise homogenised tobacco material. Homogenised tobacco material may be formed by agglomerating particulate tobacco. In a particularly preferred embodiment, the aerosol-forming substrate comprises a gathered crimped sheet of homogenised tobacco material. As used herein, the term 'crimped sheet' denotes a sheet having a plurality of substantially parallel ridges or corrugations.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol. Preferably, the aerosol former is glycerine. Where present, the homogenised tobacco material may have an aerosol-former content of equal to or greater than 5 percent by weight on a dry weight basis, and preferably from about 5 percent to about 30 percent by weight on a dry weight basis. The aerosol-forming substrate may comprise other additives and ingredients, such as flavourants.

In any of the above embodiments, the aerosol-generating article and the chamber of the aerosol-generating device may be arranged such that the article is partially received within the chamber of the aerosol-generating device. The chamber of the aerosol-generating device and the aerosol-generating article may be arranged such that the article is entirely received within the chamber of the aerosol-generating device.

The aerosol-generating article may be substantially cylindrical in shape. The aerosol-generating article may be substantially elongate. The aerosol-generating article may have a length and a circumference substantially perpendicular to the length. The aerosol-forming substrate may be provided as an aerosol-forming segment containing an aerosol-forming substrate. The aerosol-forming segment may be substantially cylindrical in shape. The aerosol-forming segment may be substantially elongate. The aerosol-forming segment may also have a length and a circumference substantially perpendicular to the length.

The aerosol-generating article may have a total length between approximately 30 millimetres and approximately 100 millimetres. In one embodiment, the aerosol-generating article has a total length of approximately 45 millimetres. The aerosol-generating article may have an external diameter between approximately 5 millimetres and approximately 12 millimetres. In one embodiment, the aerosol-generating article may have an external diameter of approximately 7.2 millimetres.

The aerosol-forming substrate may be provided as an aerosol-forming segment having a length of between about 7 millimetres and about 15 millimetres. In one embodiment, the aerosol-forming segment may have a length of approximately 10 millimetres. Alternatively, the aerosol-forming segment may have a length of approximately 12 millimetres.

The aerosol-generating segment preferably has an external diameter that is approximately equal to the external diameter of the aerosol-generating article. The external diameter of the aerosol-forming segment may be between approximately 5 millimetres and approximately 12 millimetres. In one embodiment, the aerosol-forming segment may have an external diameter of approximately 7.2 millimetres.

The aerosol-generating article may comprise a filter plug. The filter plug may be located at a downstream end of the aerosol-generating article. The filter plug may be a cellulose acetate filter plug. The filter plug is approximately 7 millimetres in length in one embodiment, but may have a length of between approximately 5 millimetres to approximately 10 millimetres.

The aerosol-generating article may comprise an outer paper wrapper. Further, the aerosol-generating article may comprise a separation between the aerosol-forming substrate and the filter plug. The separation may be approximately 18 millimetres, but may be in the range of approximately 5 millimetres to approximately 25 millimetres.

Advantageously, configuring the inductor coil to contact an aerosol-generating article received within the inductor coil may increase heating of the aerosol-generating article during use. For example, an inductor coil typically exhibits a relatively small amount of resistive heating when an alternating electric current is provided to the inductor coil. Therefore, providing contact between the inductor coil and the aerosol-generating article may facilitate conductive transfer of heat from the inductor coil to the aerosol-generating article.

Advantageously, configuring the inductor coil to contact an aerosol-generating article received within the inductor coil may facilitate retention of the aerosol-generating article within the aerosol-generating device during use. For example, the contact between the inductor coil and the aerosol-generating article may provide a desired degree of friction to reduce the risk of the aerosol-generating article sliding out of the chamber during use.

Advantageously, arranging the inductor coil to contact an aerosol-generating article received within the inductor coil may reduce or minimise the distance between the inductor coil and a susceptor element. Advantageously, arranging the inductor coil to contact an aerosol-generating article received within the inductor coil eliminates any intervening materials between the inductor coil and the aerosol-generating article. Advantageously, one or both of these features may maximise the inductive energy transfer from the inductor coil to the susceptor element. This may be particularly significant in embodiments in which the susceptor element is positioned inside the aerosol-generating article during use.

The aerosol-generating device may comprises a chamber. The housing may at least partially define the chamber. Preferably, the chamber comprises an open end through which an aerosol-generating article is inserted into the inductor coil. Preferably, the chamber comprises a closed end opposite the open end. During use, an aerosol-generating article is received within the chamber when the aerosol-generating article is received within the inductor coil.

Advantageously, the chamber may facilitate assembly of the aerosol-generating device. In particular, the chamber may retain the inductor coil in a desired position within the housing.

The inductor coil may be at least partially disposed within the chamber.

The aerosol-generating device may comprise any of the optional or preferred features described herein with reference to the first aspect of the present invention.

FIGS. 1 to 4 show an aerosol-generating system 10 in accordance with a first embodiment of the present invention. The aerosol-generating system 10 comprises an aerosol-generating device 12 and an aerosol-generating article 14.

The aerosol-generating device 12 comprises a housing 16 defining a chamber 18 for receiving a portion of the aerosol-generating article 14. The chamber 18 comprises an open end 20 through which the aerosol-generating article 14 is inserted into the chamber 18 and a closed end 22 opposite the open end 20. A susceptor element 24 extends from the closed end 22 of the chamber 18 for insertion into the aerosol-generating article 14.

The aerosol-generating device 12 also comprises an inductor coil 26 comprising a plurality of windings 28 disposed within the chamber 18 and extending around the susceptor element 24. Positioning the inductor coil 26 within the chamber 18 reduces the distance between the inductor coil 26 and the susceptor element 24. Positioning the inductor coil 26 within the chamber 18 also eliminates any portion of the housing 16 between the inductor coil 26 and the susceptor element 24.

The housing 16, the chamber 18, the inductor coil 26 and the susceptor element 24 are concentrically disposed with respect to a central axis 29 of the aerosol-generating device 12.

The aerosol-generating device 12 also comprises a controller 30 and a power supply 32 connected to the inductor coil 26. The controller 30 is configured to provide an alternating electric current from the power supply 32 to the inductor coil 26 to generate an alternating magnetic field, which inductively heats the susceptor element 24.

The aerosol-generating article 14 comprises an aerosol-forming substrate 34 in the form of a tobacco plug, a hollow acetate tube 36, a polymeric filter 38, a mouthpiece 40 and an outer wrapper 42. During use, a portion of the aerosol-generating article 14 is inserted into the chamber 18 and the inductor coil 26 so that the aerosol-generating article 14 contacts the inductor coil 26. When the aerosol-generating article 14 is inserted into the chamber 18, the susceptor element 24 is inserted into the aerosol-forming substrate 34. The controller 30 provides the alternating electric current to the inductor coil 26 to inductively heat the susceptor 24, which heats the aerosol-forming substrate 34 to generate an aerosol. The aerosol-generating device 12 comprises an air inlet 44 extending through the housing 16 and providing fluid communication between the exterior of the aerosol-generating device 12 and the chamber 18 adjacent the closed end 22. During use, a user draws on the mouthpiece 40 of the aerosol-generating article 14 to draw an airflow into the chamber 18 via the air inlet 44. The airflow then flows into the aerosol-forming substrate 34 at which point the aerosol is entrained in the airflow. The airflow and aerosol then flow through the hollow acetate tube 36, the polymeric filter 38 and a mouthpiece 40 for delivery to the user.

Figure 5:
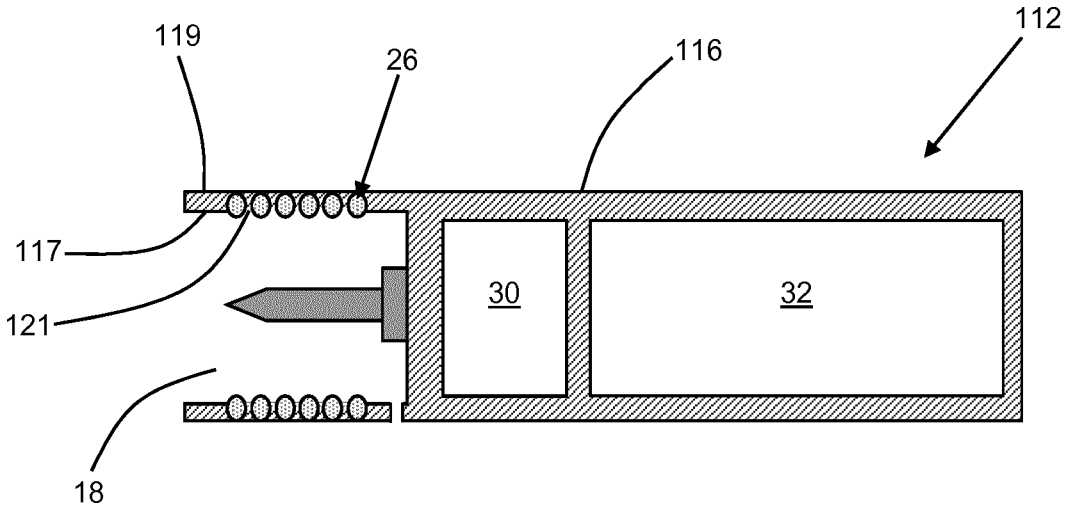
FIG. 5 shows a cross-sectional view of an aerosol-generating device according to a second embodiment of the present invention.

FIG. 5 shows a cross-sectional view of an aerosol-generating device 112 according to a second embodiment of the invention. The aerosol-generating device 112 is similar to the aerosol-generating device 12 described with reference to FIGS. 1 to 4 and like reference numerals are used to designate like parts.

The aerosol-generating device 112 comprises a housing 116 having an inner housing portion 117 defining the chamber 18 and an outer housing portion 119 spaced apart from the inner housing portion 117. The housing 116 further comprises an annular slot 121 within the inner housing portion 117 and in communication with the chamber 18. The inductor coil 26 is disposed within the slot 121 so that the inductor coil 26 partially extends into the chamber 18. An outer surface of the inductor coil 26 abuts an inner surface of the outer housing portion 119. The aerosol-generating device 112 can be combined with the aerosol-generating article 14 described with reference to FIGS. 1 to 4, and operation of the aerosol-generating device 112 is identical to the operation of the aerosol-generating device 12.

Figure 6:
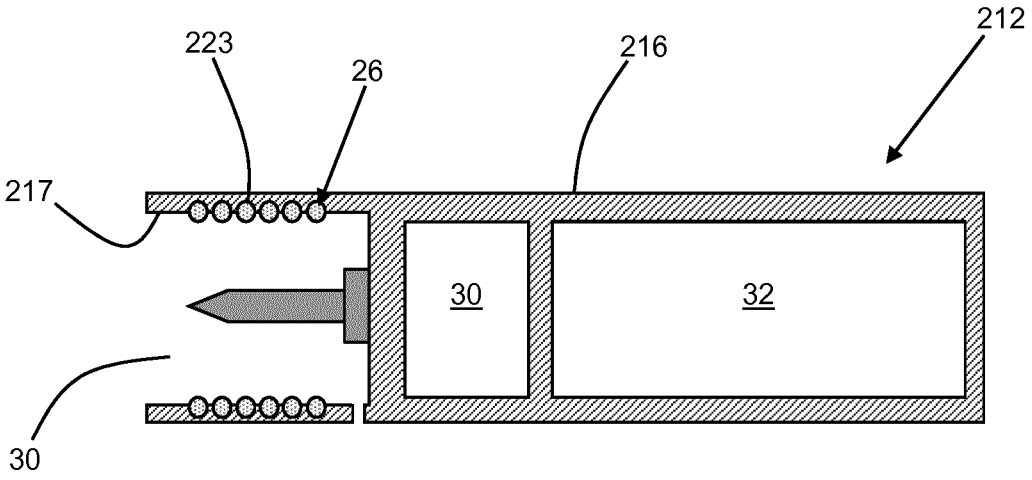
FIG. 6 shows a cross-sectional view of an aerosol-generating device according to a third embodiment of the present invention.

FIG. 6 shows a cross-sectional view of an aerosol-generating device 212 according to a third embodiment of the invention. The aerosol-generating device 212 is similar to the aerosol-generating device 112 described with reference to FIG. 5 and like reference numerals are used to designate like parts.

The aerosol-generating device 212 comprises a housing 216 comprising an inner housing portion 217 that is overmoulded with respect to the inductor coil 26 to form a recess 223 in which the inductor coil 26 is disposed so that the inductor coil 26 partially extends into the chamber 18. An outer surface of the inductor coil 26 abuts the portion of the inner housing portion 217 forming the recess 223. The aerosol-generating device 112 can be combined with the aerosol-generating article 14 described with reference to FIGS. 1 to 4, and operation of the aerosol-generating device 112 is identical to the operation of the aerosol-generating device 12.

Figure 7:
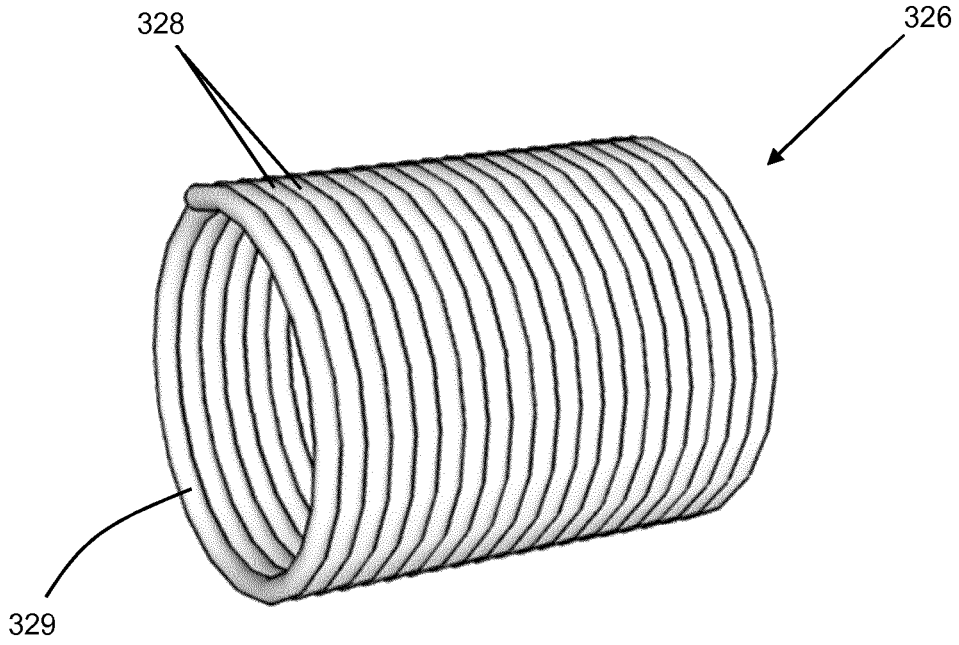
FIG. 7 shows a perspective view of an alternative inductor coil arrangement in accordance with the present invention.

FIG. 7 shows an alternative inductor coil 326 which may be used with any of the aerosol-generating devices described with reference to FIGS. 1 to 6, instead of the inductor coil 26. Each winding 328 of the inductor coil 326 contacts the adjacent windings 328 to eliminate gaps between the windings 328. This reduces or prevent contaminants or debris becoming lodged between the windings 328 and increases the inductance of the inductor coil 328. To prevent electrical short circuits between adjacent windings 328 the inductor coil 326 is formed from a conductive wire that is coated with an electrically insulating outer layer 329.

Figure 8:
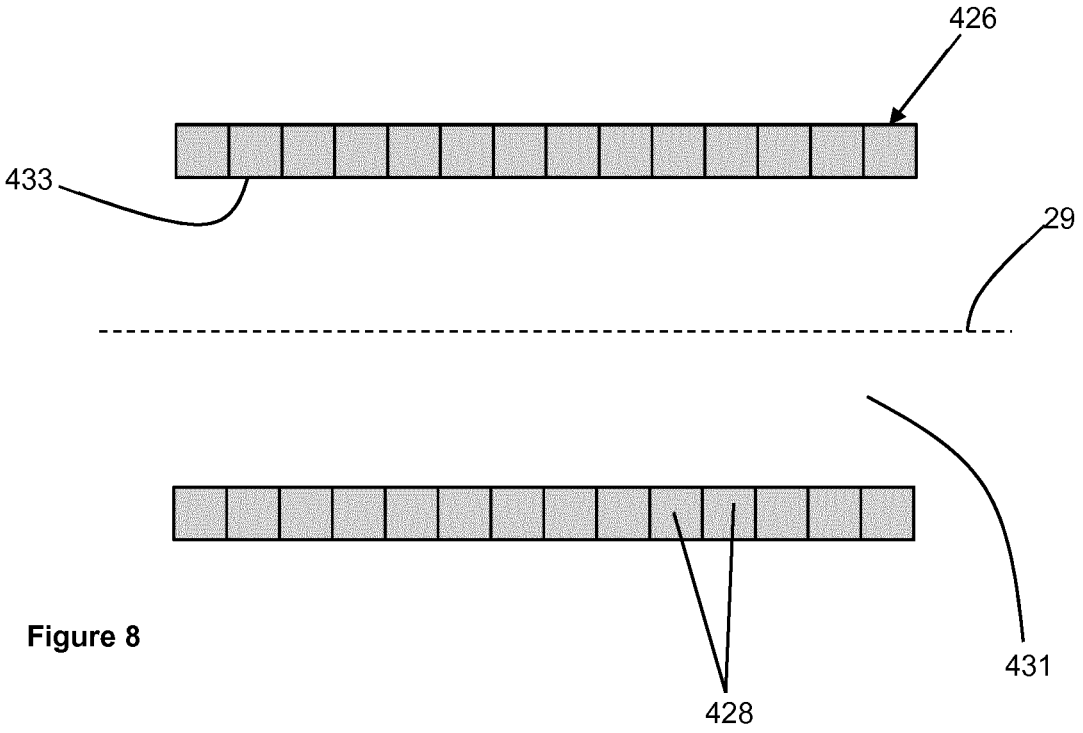
FIG. 8 shows a cross-sectional view of a further alternative inductor coil arrangement in accordance with the present invention.

FIG. 8 shows a cross-sectional view of a further alternative inductor coil 426. The inductor coil 426 is substantially the same as the inductor coil 326 shown in FIG. 7, except the inductor coil 426 is formed from a wire having a square cross-sectional shape. The inductor coil 426 defines a lumen 431 extending through the inductor coil 426 for receiving a portion of the aerosol-generating article 14. The windings 428 of the inductor coil 426 have the same diameter so that the cross-sectional area of the lumen 431 remains constant along the central axis 29. The result of this arrangement is an inner surface 433 of the inductor coil 426 that is substantially smooth along the central axis 29.

Figure 9:
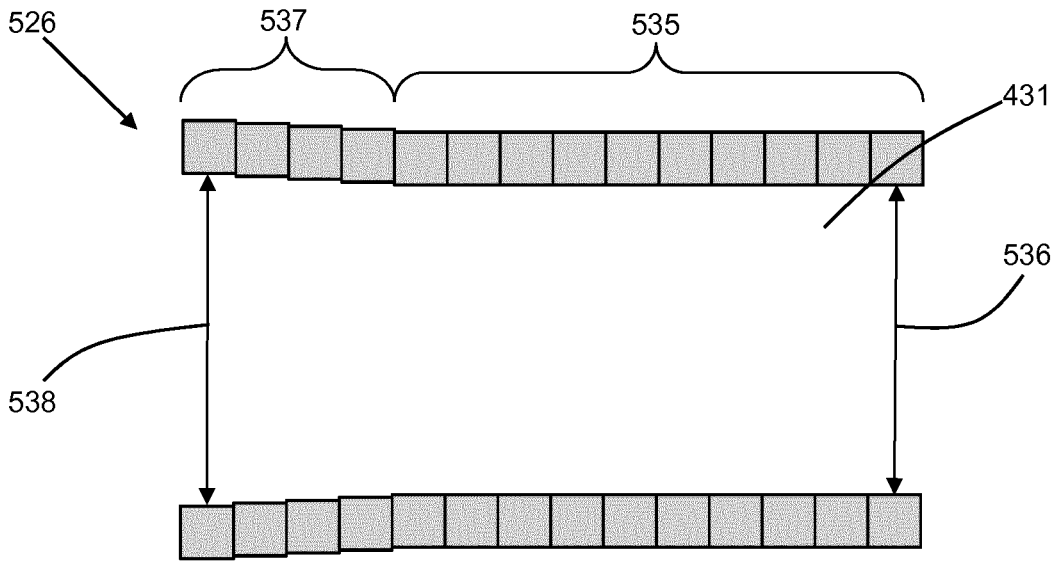
FIG. 9 shows a cross-sectional view of a yet further alternative inductor coil arrangement in accordance with the present invention.

FIG. 9 shows a cross-sectional view of a yet further alternative inductor coil 526. The inductor coil 526 is similar to the inductor coil 426 described with reference to FIG. 8. The inductor coil 526 differs by comprising a first section 535 in which the cross-sectional area 536 of the lumen 431 remains constant and a second section 537 in which the cross-sectional area 538 of the lumen 431 increases in a direction away from the first section 535. The larger cross-sectional area of the lumen 431 in the second section 537 may facilitate insertion of the aerosol-generating article 14 into the lumen 431.

The invention claimed is:

1. An aerosol-generating device, comprising:

a housing defining a chamber configured to receive at least a portion of an aerosol-generating article;

an inductor coil disposed at least partially within the chamber, wherein the housing defines a recess in an inner surface of the chamber, and wherein the inductor coil is at least partially disposed within the recess; and a power supply and a controller connected to the inductor coil and configured to provide an alternating electric current to the inductor coil such that the inductor coil generates an alternating magnetic field to inductively heat a susceptor element and thereby heat at least a portion of the aerosol-generating article received within the inductor coil.

2. The aerosol-generating device according to claim 1, further comprising an elongate susceptor element disposed at least partially within the inductor coil.

3. The aerosol-generating device according to claim 1, wherein the inductor coil is configured to receive at least a portion of the aerosol-generating article within the inductor coil, and wherein the inductor coil is configured so that, when the aerosol-generating article is received within the inductor coil, the inductor coil contacts the aerosol-generating article.

4. The aerosol-generating device according to claim 1, wherein an outer surface of the inductor coil is overmoulded with a portion of the housing, and wherein said portion of the housing forms the recess.

5. The aerosol-generating device according to claim 1, wherein the inductor coil is formed from a resilient material so that windings of the inductor coil are biased against an inner surface of the chamber.

6. The aerosol-generating device according to claim 1, wherein each winding of the inductor coil contacts adjacent windings of the inductor coil.

7. The aerosol-generating device according to claim 6, wherein the inductor coil is formed from a wire comprising an electrically conductive core and an outer layer surrounding the electrically conductive core, the outer layer comprising an electrically insulating material.

8. The aerosol-generating device according to claim 1, wherein the inductor coil is formed from a wire having a rectangular cross-sectional shape.

9. The aerosol-generating device according to claim 8, wherein planar surfaces of each winding of the inductor coil contact planar surfaces of adjacent windings of the inductor coil.

10. The aerosol-generating device according to claim 9, wherein the inductor coil defines a lumen extending through the inductor coil configured to receive the aerosol-generating article, and wherein a plurality of consecutive windings of the inductor coil define a first portion of the lumen having a constant cross-sectional area.

11. The aerosol-generating device according to claim 10, wherein the lumen has a first end, a second end, and a length extending between the first end and the second end, and wherein the lumen has a constant cross-sectional area along the length of the lumen.

12. The aerosol-generating device according to claim 10, wherein the inductor coil is arranged within the housing so that an aerosol-generating article inserted into the inductor coil enters the lumen through a first end of the lumen, wherein a second portion of the lumen extends between the first portion of the lumen and the first end of the lumen, and wherein a cross-sectional area of the second portion increases in a direction from the first portion towards the first end.

13. The aerosol-generating device according to claim 12, wherein the lumen has a second end opposite the first end, and wherein the first portion of the lumen extends between the second portion and the second end of the lumen.

14. An aerosol-generating system, comprising:

an aerosol-generating device according to claim 1; and an aerosol-generating article having an aerosol-forming substrate and being configured for the aerosol-generating device.

* * * * *